US005245794A

United States Patent [19]

Salugsugan

[11] Patent Number: 5,245,794

[45] Date of Patent: Sep. 21, 1993

[54] AUDIO END POINT DETECTOR FOR CHEMICAL-MECHANICAL POLISHING AND METHOD THEREFOR

[75] Inventor: Isi Salugsugan, Fremont, Calif.

[73] Assignee: Advanced Micro Devices, Inc., Sunnyvale, Calif.

[21] Appl. No.: 865,432

[22] Filed: Apr. 9, 1992

[51] Int. Cl.[5] ..... B24B 41/00

[52] U.S. Cl. ..... 51/165.74; 51/165.76; 51/165.88; 51/131.3

[58] Field of Search ..... 51/165 R, 165.71, 165.74, 51/165.76, 131.1, 131.2, 131.3, 132, 165.72, 283 R; 156/626, 627

[56] References Cited

U.S. PATENT DOCUMENTS

| | | | |
|---|---|---|---|
| 3,841,031 | 10/1974 | Walsh | 51/283 |
| 4,193,226 | 3/1980 | Gill, Jr. et al. | 51/124 R |
| 4,358,338 | 11/1982 | Downey et al. | 156/627 |
| 4,462,860 | 7/1984 | Szmanda | 156/626 |
| 4,680,893 | 7/1987 | Cronkhite et al. | 51/131.3 |
| 4,687,539 | 8/1987 | Burns et al. | 156/626 |
| 4,693,036 | 9/1987 | Mori | 51/131.3 |
| 4,695,700 | 9/1987 | Provence et al. | 219/121 PD |
| 4,717,446 | 1/1988 | Nagy et al. | 156/626 |
| 4,767,495 | 8/1988 | Nishioka | 156/626 |
| 4,793,895 | 12/1988 | Kaanta et al. | 156/627 |
| 4,811,522 | 3/1989 | Gill, Jr. | 51/165.9 |
| 4,846,920 | 7/1989 | Keller et al. | 156/626 |
| 4,948,259 | 9/1990 | Enke et al. | 156/626 |
| 4,953,982 | 9/1990 | Ebbing et al. | 356/35.1 |
| 4,954,212 | 9/1990 | Gabriel et al. | 156/627 |
| 4,975,141 | 12/1990 | Greco et al. | 156/626 |
| 4,998,021 | 3/1991 | Mimasaka | 156/626 |
| 5,036,015 | 7/1991 | Sandhu et al. | 51/165 R |
| 5,045,149 | 9/1991 | Nulty | 156/627 |
| 5,069,002 | 12/1991 | Sandhu et al. | 51/165 R |
| 5,081,796 | 1/1992 | Schultz | 51/165.74 |
| 5,122,481 | 6/1992 | Nishiguchi | 51/131.3 |

*Primary Examiner*—M. Rachuba

*Attorney, Agent, or Firm*—Lowe, Price, LeBlanc & Becker

[57] ABSTRACT

An apparatus for detecting a polishing endpoint during chemical-mechanical planarization/polishing of a wafer senses an acoustic wave generated by rubbing contact between a polish pad and a hard surface underlying a softer material being removed. The apparatus includes a transducer for converting the acoustic wave energy in the range of 30 to 100 Hertz into an audio signal. The audio signal is processed by a low pass cutoff filter to remove high frequency noise. The filtered audio signal is supplied to a phase lock loop to detect a predetermined audio frequency and, in response, provide a logic signal to an integrator. The integrator integrates the logic signal over time to eliminate transient noise spikes, and supplies a detection signal only upon receiving the logic signal for a predetermined period. The detection signal starts a counter to provide a predetermined over-polishing time prior to termination of polishing operations.

25 Claims, 5 Drawing Sheets

AUDIO END POINT DETECTOR FOR CHEMICAL-MECHANICAL POLISHING AND METHOD THEREFOR

TECHNICAL FIELD

The invention relates to semiconductor device manufacture and, more particularly, to detecting a planar endpoint in a semiconductor wafer during chemical-mechanical polishing.

BACKGROUND ART

Semiconductor integrated circuits are manufactured by forming an array of separate dies on a common semiconductor wafer. Upon completion of processing steps forming the circuitry on the wafer, the wafer is scored and diced to form individual chips which are mounted in individual packages.

During processing, the wafer is treated to form specified regions of insulating, conductive, and semiconductor type materials. For example, conductive regions of polysilicon are conventionally formed in trenches of a silicon substrate to constitute bonding pads, high density interconnections, capacitor plates, etc. of static random access memories (SRAM), microprocessors, and other integrated circuits.

FIGS. 1A and 1B depict an initial processing stage for forming an integrated circuit. A silicon wafer constitutes silicon substrate 20 with a trench 22 formed therein. A high temperature polysilicon layer 24 is formed approximately 1.6 microns thick on the exposed surface of the substrate and in trench 22. Residual polysilicon bordering trench 22 must be removed to leave polysilicon only in the trench. Removal of the residual polysilicon can be performed by plasma etching which nominally removes polysilicon at a rate of approximately 4,000Å to 6,000Å a minute. Alternatively, residual polysilicon can be removed by chemical mechanical planarization or polishing (CMP) to remove polysilicon at a rate of approximately one micron per minute. This latter process is simpler, faster and less expensive to perform.

A polisher for performing CMP is schematically depicted is FIG. 2. Such apparatus are further described in U.S. Pat. Nos. 4,193,226 and 4,811,522 to Gill, Jr. and U.S. Pat. No. 3,841,031 to Walsch, the disclosures thereof being incorporated herein by reference. A commercially available wafer polisher is the Model 372 Polisher manufactured by Westech Systems, Inc.

Referring to FIG. 2, polisher 100 includes a twenty-four inch diameter rotatable aluminum polishing platen 102. Polish pad 104 is a RODELL Suba IV perforated polyester nap mounted on platen 102. Platen 102 and polish pad 104 are driven by a microprocessor controlled motor (not shown) to spin at approximately 100 RPM and to maintain a nominal temperature of 41 degrees Celsius. Wafer 106 has a diameter of between five to seven inches and is mounted on the bottom of a rotatable polishing head 108 so that a lower major surface of wafer 106 to be polished is positionable to contact underlying polish pad 104.

Wafer 106 and polishing head 108 are attached to a vertical polish spindle 110 which, in turn, is rotatably mounted in a lateral robotic arm 112. Robotic arm 112 rotates the polishing head 108 at approximately 25 revolutions per minute in the same direction as platen 102 and radially positions the polishing head over a range of 20 to 30 millimeters at a speed of 3 millimeters per second. The arm also vertically positions head 108 to bring wafer 106 into contact with polish pad 104 and maintain a polishing contact pressure of 6 pounds per square inch, or 192 pounds of down force, for a typical six to seven inch diameter wafer.

A slurry tube 114 opposite polishing head 108 above polish pad 104 dispenses and evenly saturates the pad with slurry 116. The slurry is a potassium hydroxide base solution having a pH of approximately 10.5 to 11.0, such as Nalco 2371. Using this slurry, it is possible to polish through the 1.6 micron thick polysilicon layer 24 in approximately 2.5 minutes.

The resultant polysilicon pad 26 after removal of residual polysilicon by CMP is shown in FIG. 3. If polysilicon pad 26 has an area on the order of 50 microns square and 5,000Å DGEP, the pad will be dished out during polishing with more polysilicon being removed in a central portion than at peripheral portions of the pad. The amount of polysilicon loss can be as much as the total thickness of the trench at the center area. This is due to compliance of polish pad 104. Heat generated by polish pad 104 during polishing increases an exothermic reaction between the slurry and polysilicon. Thus, a central portion of the relatively soft polysilicon is more rapidly removed than peripheral portions when soft polishing pad 104 conforms under pressure to the polysilicon surface.

To minimize dishing of the polysilicon during planarization, the polysilicon may be formed in a plurality of elongate trenches with intervening ridges of harder silicon oxide substrate material. The silicon oxide is more resistant to polishing than the relatively softer polysilicon and therefore acts as a polishing stop. The ratio of polysilicon to intervening silicon oxide surface area is adjustable based on the acceptable degree of dishing and the total area of polysilicon required. Typically, a polysilicon-to-silicon dioxide ratio in the range of one to one is satisfactory.

Referring to FIG. 4, a method of forming a polysilicon region in a substrate 20 using substrate silicon dioxide as a polishing stop includes a step of forming a plurality of parallel trenches 28 with intervening silicon oxide ridges 34. The trenches can be formed by conventional techniques including photo and ion etching. A polysilicon film 30 (FIGS. 5A and 5B) is formed on the exposed surface of substrate 20 including ridges 34 and trenches 28. The wafer is then polished using CMP as described above to remove residual polysilicon.

Because the intervening silicon oxide ridges are resistant to CMP, polishing is inhibited upon removal of the residual polysilicon when encountering the relatively harder silicon oxide ridges 34 that act as a polishing stop. The resultant structure, shown in FIGS. 6A and 6B, includes a plurality of elongate polysilicon filled trenches 32 having upper surfaces coplanar with intermediate silicon oxide ridges 34 and peripheral portions of substrate 20.

After CMP, connective structures, such as silicide/aluminum interconnect layer 36 (FIG. 7), can be formed on polysilicon filled trenches 32. Subsequent processing steps are performed using conventional methods which may include subsequent CMP of overlying layers.

A problem with CMP is the need to determine the required degree of polishing to avoid underpolishing and overpolishing. Referring to FIG. 8, if polishing is incomplete, residual polysilicon bridges 38 remain on silicon oxide ridges 36 and on peripheral surfaces 40 of substrate 20. The residual polysilicon bridges are conductive and tend to short-circuit polysilicon filled trenches 32 to surrounding structures. Conversely, although the intermediate silicon oxide ridges 34 impede overpolishing, some dishing of the array of polysilicon filled trenches 32 occurs as shown in FIG. 9. This is due to mechanical erosion, i.e., scraping away, of the silicon oxide due in part to polishing pad compliance.

Conventionally, polishing is performed for a time period predetermined to completely remove residual portions of the polysilicon without overpolishing and resultant dishing. The time is determined based on previous trial runs and taking into consideration polishing conditions including substrate and slurry properties, surface area, etc. However, this open loop technique is error prone and does not account for processing variations nor is it readily adaptable to different products without extensive trialing runs.

Prior art solutions to overpolishing include monitoring wafer induced drag of the polishing platen and detecting a change in a sense current through the wafer.

U.S. Pat. Nos. 5,036,015 and 5,069,002 of Sandhu et al. describe a method and apparatus for detecting a planar endpoint during CMP of a wafer. The planar endpoint is detected by sensing a change in friction between the wafer and a polishing surface caused by removal of the oxide coating of the wafer and polish pad contact of a hard lower layer. Resistance is detected by measuring current changes of electric motors rotating the wafer and/or the polishing platen.

U.S. Pat. No. 4,793,895 of Kaanta et al. describes an apparatus and method for monitoring the conductivity of a semiconductor wafer during polishing. A polishing pad includes embedded active and passive electrodes therein. A detector connected to the electrodes monitors a current between them as the wafer is lapped by the polishing pad. An etch endpoint of the wafer is determined by the magnitude of the detected current.

A disadvantage of the prior art methods and apparatus for detecting a polishing endpoint is the requirement for modification to the drive system of the polisher and/or to the polishing pad. Further, the prior art systems require significant additional circuitry that must be calibrated for particular wafer polishing characteristics and conductivity. There is the additional drawback of possible damage to the wafer by methods requiring electrical probing to determine an endpoint. The more passive drag detecting systems are subject to calibration error as motor characteristics change over time and under varying external loading conditions.

Accordingly, a need exists for an accurate device and method for accurately detecting a CMP endpoint.

A need further exists for a CMP endpoint detector and detection method able to be implemented without extensive modification to existing polishing equipment.

A need further exists for a CMP endpoint detector and detection method that accommodate a variety of manufacturing variables without requiring recalibration.

A need further exists for a CMP endpoint detector and detection method that does not pose a damage hazard to a wafer being polished.

DISCLOSURE OF THE INVENTION

It is accordingly an object of the invention to accurately detect an endpoint of a chemical-mechanical planarization/polishing (CMP) process.

It is another object of the invention to provide CMP endpoint detection without extensive modification to existing polishing equipment.

It is another object of the invention to provide CMP endpoint detection that accommodates a variety of manufacturing variables without requiring recalibration.

It is another object of the invention to provide CMP endpoint detection without posing a damage hazard to a wafer being polished.

According to one aspect of the invention, an apparatus for detecting an endpoint during mechanical planarization of a semiconductor wafer on a wafer polisher includes a transducer element for sensing acoustic wave energy to supply an audio signal. A filter having a predetermined passband filters the audio signal to supply a filtered audio signal to a detector circuit. The detector circuit is responsive to a characteristic of the filtered audio signal to supply an endpoint detection signal to the wafer polisher.

According to another aspect of the invention, the endpoint detector includes a phase lock loop responsive to a predetermined frequency of the filtered audio signal for supplying a first logic signal to an integrator. In response, the integrator integrates the first logic signal over time and supplies an integrated output signal. A threshold detector compares the integrated output signal with a predetermined threshold level and, in response, supplies the endpoint detection signal.

According to another aspect of the invention a counter is responsive to the endpoint detection signal and to a clock signal for supplying an overpolish signal. A comparator, responsive to the overpolish signal, supplies a stop polishing signal after a predetermined amount of overpolishing.

According to a feature of the invention the transducer comprises a microphone and an audio amplifier.

According to another aspect of the invention a polisher controller is responsive to the endpoint detection signal for supplying control signals to a mechanical wafer polisher. The polisher controller may include control circuitry for controlling pressure applied to a wafer, rotation speed of the mechanical wafer polisher, and position of the wafer.

According to another feature of the invention the filter transmits the audio signal within a passband frequency range of 30 to 100 Hertz with no more than 3 dbv attenuation and attenuating frequencies outside the passband frequency range by at least 3 dbv.

According to another feature of the invention the filter attenuates components of the audio signal having a frequency of greater than 200 Hertz by at least 60 dbv.

According to another aspect of the invention, a mechanical planarization apparatus for polishing a semiconductor wafer includes a controller for supplying a control signal, a rotatable polishing platen, a motor responsive to the control signal for rotating the platen, and a polishing head for holding the wafer against the rotatable polishing platen. A sensor senses acoustic wave energy generated by the wafer held against the polishing platen to supply a detected signal to a detector. In response to the detected signal, the detector supplies an endpoint detection signal to the controller.

According to a method of the invention, the major surface of a wafer is mechanically polished with a predetermined acoustic signal produced as a result detected and the mechanical polishing controlled in response thereto. The control step may include terminating the polishing step.

According to a feature of the inventive method, the acoustic signal is filtered after detection by the detecting step.

According to another aspect of the method of the invention, the polishing step further includes steps of applying polishing agent to the wafer and mechanically polishing the wafer with the polishing agent.

According to another aspect of the method, the acoustic signal is delayed after detection thereof.

The foregoing and other objects, features, aspects and advantages of the present invention will become more apparent from the following detailed description of the present invention when taken in conjunction with the accompanying drawings.

BEST MODE FOR CARRYING OUT THE INVENTION

Figure 10:
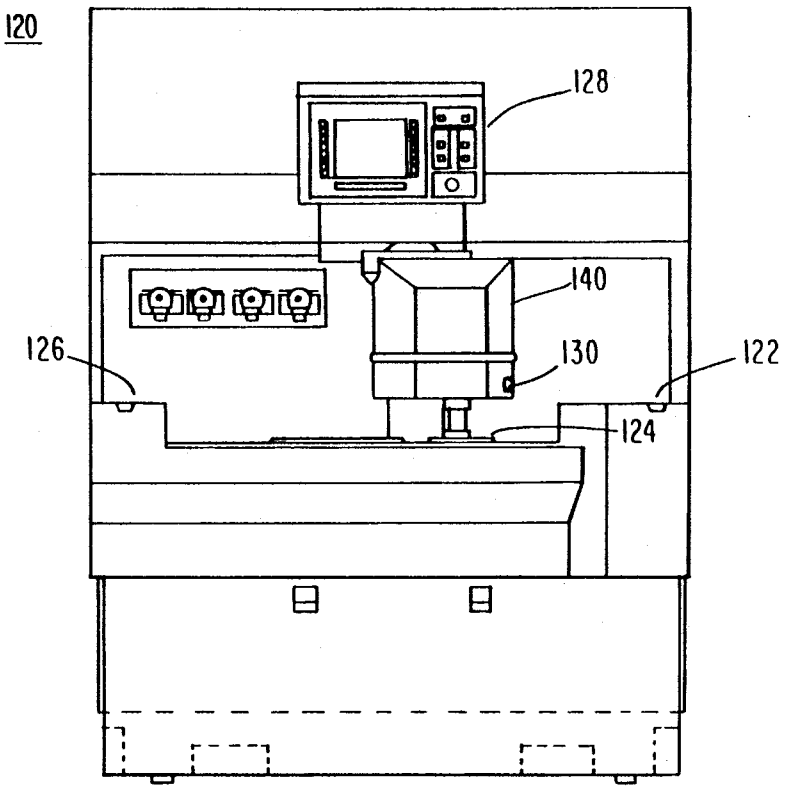
FIG. 10 is a front view of a CMP apparatus including an acoustic end point detector according to the invention.

A commercially available polisher 120, such as the Westech model 372, including end point detection apparatus 130 according to the invention is depicted in FIG. 10. Polisher 120 includes load station 122 for receiving wafers to be polished, a wafer carrier 124 attached to polish arm 140 for holding, rotating, and transporting individual wafers from load station 122, through chemical-mechanical polishing, and finally to unload cassette 126. Main controller computer 128 controls operations of polisher 120.

Acoustic transducer 130 is attached to a lower portion of polish arm 140 for sensing acoustic waves, i.e. subsonic and audible sounds, resulting from polishing of a soft layer of material to an underlying hard layer or substrate. Transducer 130 senses acoustic wave energy in the 30 to 100 Hertz frequency range and supplies a low level microphone signal output to the circuitry of the end point detector. Transducer 130 may be a commercially available Shure model SM57 microphone.

The remaining end point detector circuitry may be collocated with transducer 130 or positioned at another location where DC power is available, such as within the cabinet housing main controller computer 128.

Figure 1B:
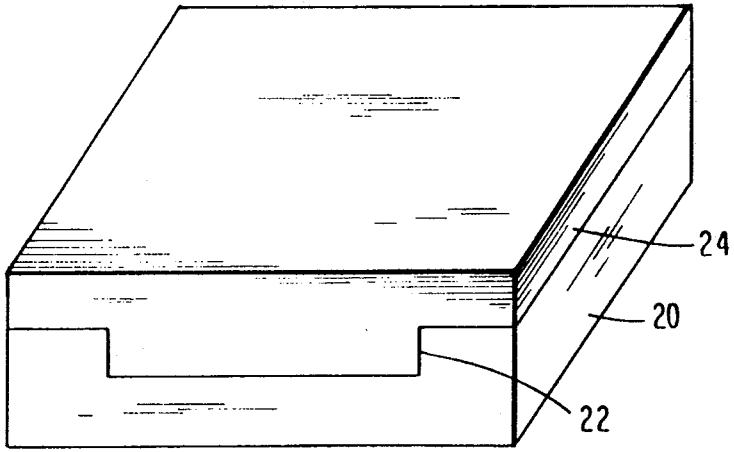
FIG. 1B is a perspective view of the structure of FIG. 1A.
Figure 1A:
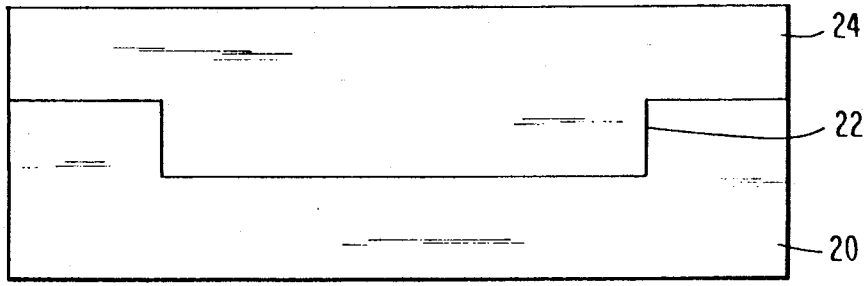
FIG. 1A is a sectional view of a polysilicon layer formed on a substrate.
Figure 3:
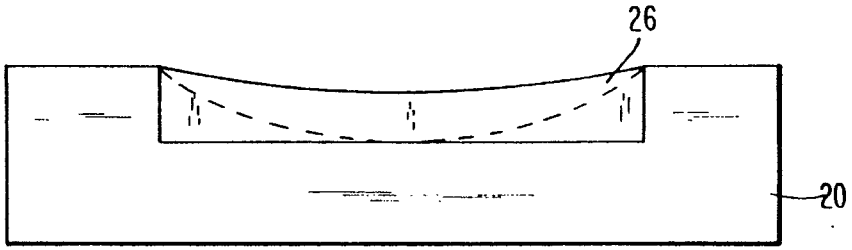
FIG. 3 is a sectional view of the structure of FIG. 1 after CMP processing.
Figure 2:
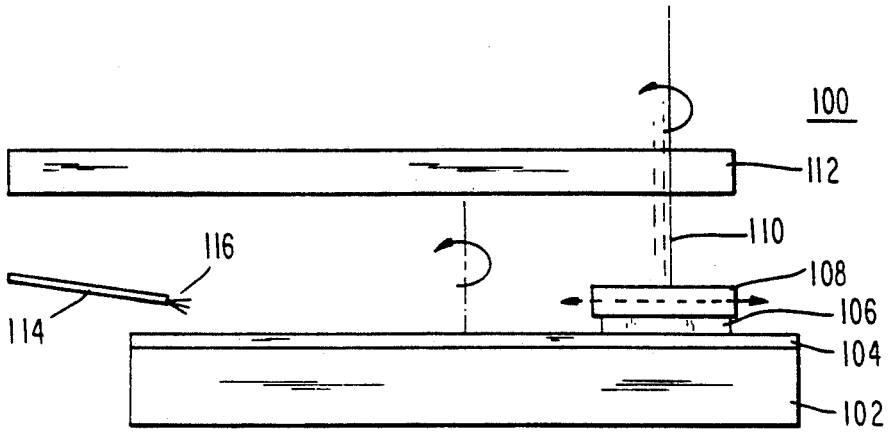
FIG. 2 is a schematic diagram of a chemical mechanical planarization/polishing (CMP) apparatus.
Figure 11:
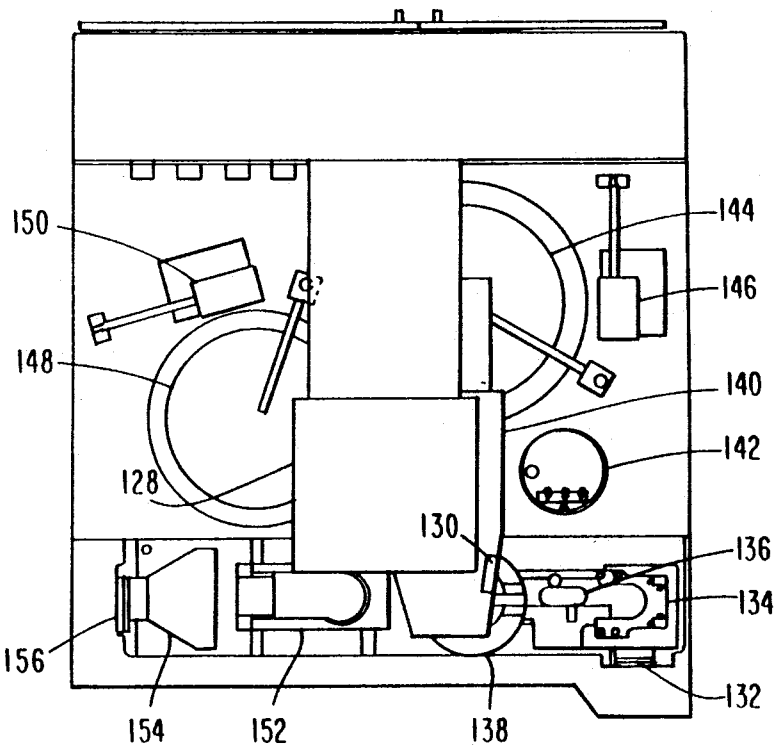
FIG. 11 is a partial plan view of the CMP apparatus of FIG. 10.

Referring to FIG. 11, wafers to be polished are stacked in a load cassette positioned by cassette load elevator 132. Wafers are loaded by load cassette shoe 134 and wafer shuttle 136 into wafer lift 138. Wafer carrier 124 is mounted on a polish spindle (FIG. 2) downwardly extending from polish arm 140. Polish arm 140 positions the wafer carrier into position over wafer lift 138 to retrieve and transport a wafer to main polish platen 144 for initial rough polishing. A primary pad conditioner 146 supplies a polishing slurry onto a polish pad covering polish platen 144.

On an opposite side of polisher 120 is a final polish platen 148 for performing final CMP of the wafer. Final pad conditioner 150 dispenses an appropriate fine slurry onto a polish pad covering final polish platen 148.

Upon completion of required polishing operations, the polished wafer is deposited onto wafer unload track 152 and transported onto cassette unload shoe 154 into an empty cassette located in a cassette unload elevator 156.

The polishing operation is performed substantially as previously detailed with both the wafer and polish pad rotating in a common rotational direction. Upon removal of an overlying soft material layer, such as polysilicon, from a wafer an underlying material of greater hardness comes into contact with the corresponding polish pad. Contact between the polish pad and the harder underlying material, such as the silicon oxide surface of a wafer substrate, generates sonic wave energy in the 30 to 100 Hertz frequency range. Emission of the sonic wave energy is detected by transducer 130 and supplied to associated signal processing elements of the end point detector.

In response to detecting a predetermined amplitude, frequency and duration of signal from transducer 130, the end point detector provides a control signal to main processor computer 128 to halt polishing operations for the wafer being processed on the particular polish platen. The wafer is then transported to a subsequent station for final polishing or is returned to a cassette for unloading.

Figure 12:
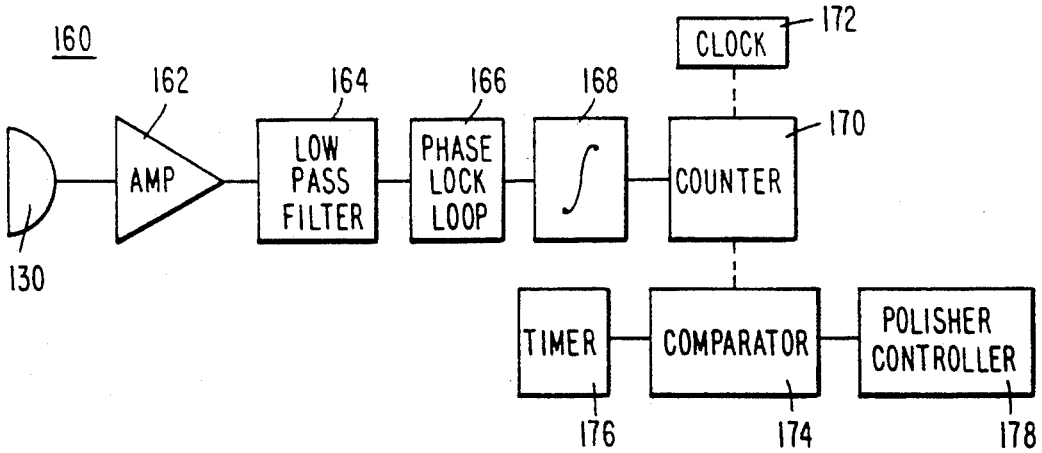
FIG. 12 is a block diagram of an acoustic end point detector according to the invention.
Figure 4:
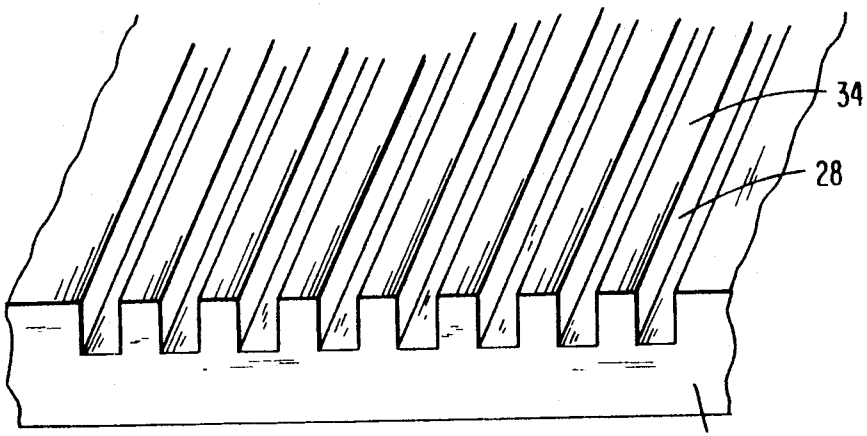
FIG. 4 is a perspective view of a substrate wafer including a plurality of parallel trenches etched therein.
Figure 5B:
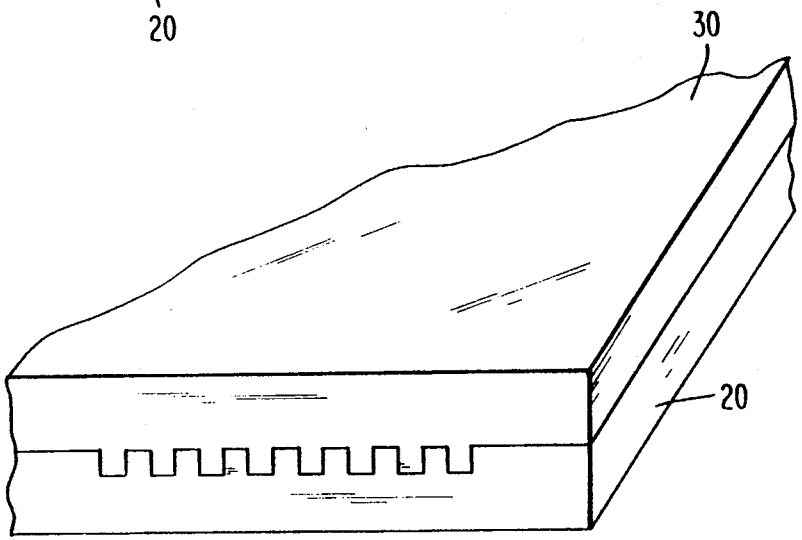
FIG. 5B is a perspective view of the structure of FIG. 5A.
Figure 5A:
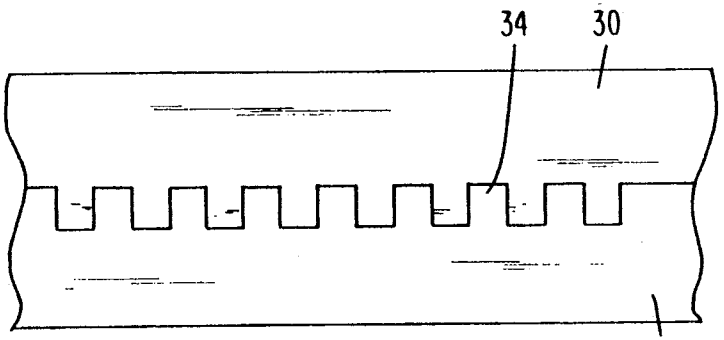
FIG. 5A is a sectional view of the structure of FIG. 4 with a polysilicon film formed thereon.
Figure 6B:
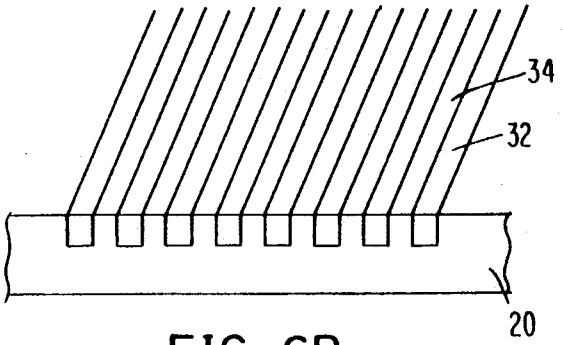
FIG. 6B is a perspective view of the structure of FIG. 6A.
Figure 6A:
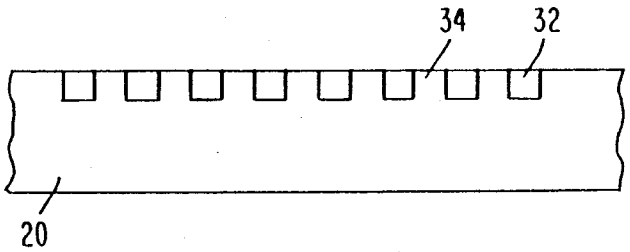
FIG. 6A is a sectional view of the structure of FIG. 5A after CMP processing.
Figure 7:
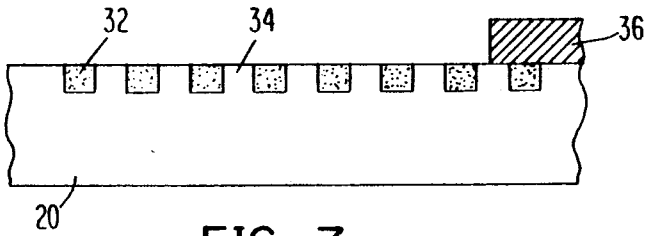
FIG. 7 is a sectional view of the structure of FIG. 6A with an interconnection layer formed thereon.
Figure 9:
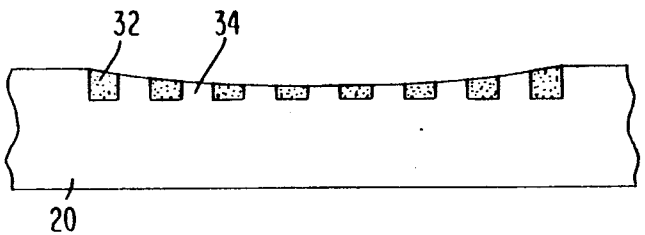
FIG. 9 is a sectional view of the structure of FIG. 5A after overpolishing using CMP processing.
Figure 8:
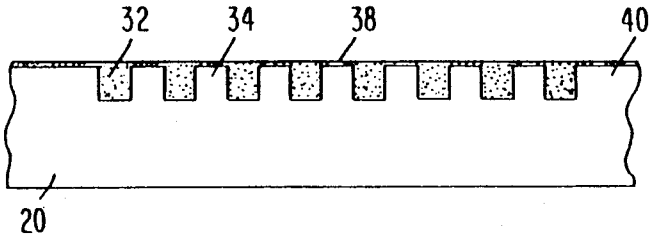
FIG. 8 is a sectional view of the structure of FIG. 5A after underpolishing using CMP processing.

Referring to the block diagram of audio end point detector 160 of FIG. 12, acoustic energy is sensed by microphone 130. A low level audio signal from microphone 130 is supplied to, and is amplified by, line level by amplifier 162. Amplifier 162 is a commercially available audio amplifier such as a Wynguard A-600.

The amplified signal from amplifier 162 is filtered by low pass filter 164 to remove signal components having a frequency above approximately 100 Hertz. Low pass filter is a commercially available component such as a PAC LP854. The filtered audio is supplied to phase lock loop 166 which supplies a logic level signal to integrator 168 upon detecting a predetermined signal frequency in the range of 30 to 100 Hertz.

Integrator 168 eliminates false triggers caused by transient noise by integrating the output from phase lock loop 166 over time. Once the audio signal of the predetermined frequency detected by phase lock loop 166 is present for a sufficient predetermined period of time, integrator 168 supplies a logic signal to counter 170.

Counter 170 receives the logic signal from integrator 168 and, in response, starts counting clock pulses supplied by clock 172. Current count data from counter 170 is supplied to comparator 174 which compares the current count representing clock pulses since successful audio detection with a predetermined count supplied by timer 176. Upon concurrence of the current count value and the predetermined count, comparator 174 provides an end of overpolish signal to polisher controller 178. In response to the end of overpolish signal, controller 178 halts polishing operation for the current wafer and either initiates a final polishing operation or causes the wafer to be transported to the unload cassette.

Because polishing is controlled in a closed-loop manner, there is no need to perform extensive trial runs to determine a required polishing time. Since the system detects a phenomenon directly associated with an end of polish condition, processing variables do not result in under or overpolishing. As a result, audio end point detection of CMP provides consistent wafer polishing without regard to processing variables.

The invention has been described with particular reference to preferred embodiments thereof. It will be understood, however, that modifications and variations can be made within the spirit and scope of the appended claims. For example, although the invention has been described in the context of, and has particular utility to, a polysilicon film formed on a silicon wafer substrate, the invention is applicable to determine an end point of other processes wherein a soft material such as aluminum, aluminum-silicon, copper, and the like are to be removed by grinding or polishing from a harder underlying material such as silicon nitride or carbon DLC. The invention is also applicable to grinding of a harder material from a softer material where grinding or polishing is continued only during detection of a predetermined audio signal frequency, the endpoint being detected by failure to detect the particular audio signal.

I claim:

1. An apparatus for detecting an endpoint during mechanical planarization of a semiconductor wafer on a wafer polisher, comprising:

a transducer positioned within audio range of said wafer for supplying an audio signal in response to acoustic wave energy generated by said wafer operating as a self-excited acoustic oscillator during the mechanical planarization;

a filter having a predetermined passband for filtering said audio signal and supplying a filtered audio signal; and a detector receiving said filtered audio signal and, responsive to a characteristic thereof, supplying an endpoint detection signal to said wafer polisher.

2. The apparatus of claim 1, said detector comprising:

a phase lock loop responsive to a predetermined frequency of said filtered audio signal for supplying a first logic signal;

integrator means for integrating said first logic signal over time and supplying an integrated output signal; and threshold detector means for comparing said integrated output signal with a predetermined threshold level and, in response, supplying said endpoint detection signal.

3. The apparatus of claim 1, further comprising:

a counter responsive to said endpoint detection signal and to a clock signal for supplying an overpolish signal; and comparator means responsive to a said overpolish signal for supplying a stop polishing signal after a predetermined amount of overpolishing.

4. The apparatus of claim 1, wherein said transducer comprises a microphone and an audio amplifier.

5. The apparatus of claim 1, further comprising a polisher controller responsive to said endpoint detection signal for supplying control signals to said wafer polisher.

6. The apparatus of claim 5, wherein said polisher controller includes means for controlling (1) polishing pressure applied to a wafer, (2) speed of rotation of said wafer polisher, and (3) wafer position.

7. The apparatus of claim 1, wherein said filter includes means for transmitting said audio signal within a passband frequency range of 30 to 100 Hertz with no more than 3 dbv attenuation and attenuating frequencies greater than 200 Hertz by at least 60 dbv relative.

8. The apparatus of claim 1, wherein said filter includes means for attenuating components of said audio signal having a frequency of greater than 200 Hertz by at least 60 dbv.

9. In a mechanical planarization apparatus for a wafer having a polishing head for holding the wafer against a rotatable polishing platen, an endpoint detection apparatus comprising:

a microphone for supplying a detected signal in response to sensing acoustic wave energy generated by said wafer when held against said polishing platen; and detector means responsive to said detected signal for supplying an endpoint detection signal to said mechanical planarization apparatus.

10. The endpoint detection apparatus according to claim 9, further comprising:

filter means operating on said detected signal for substantially attenuating components of said detected signal outside a predetermined range of signal frequencies.

11. The endpoint detection apparatus according to claim 10, wherein said predetermined range of frequencies is from 30 Hertz to 100 Hertz.

12. The endpoint detection apparatus according to claim 9, further comprising:

timer means for delaying said endpoint detection signal from said filter means for a predetermined period prior to supplying said endpoint detection signal to said mechanical planarization apparatus.

13. The endpoint detection apparatus according to claim 10, further comprising noise filter means for conditioning said endpoint detection signal from said filter means prior to supplying said endpoint detection signal to said mechanical planarization apparatus.

14. The endpoint detection apparatus according to claim 13, wherein said noise filter means includes signal integration means for integrating said endpoint detection signal over time.

15. A mechanical planarization apparatus for polishing a semiconductor wafer, comprising:

a controller for supplying a control signal;

a rotatable polishing platen;

a motor responsive to said control signal for rotating said platen;

a polishing head for holding the wafer against said rotatable polishing platen;

sensor means for supplying a detected signal in response to sensing acoustic wave energy generated by said wafer operating as a self-excited acoustic oscillator when held against said polishing platen; and detector means responsive to said detected signal for supplying an endpoint detection signal to controller.

16. The mechanical planarization apparatus according to claim 15, further comprising:

filter means operating on said detected signal for substantially attenuating components of said detected signal outside a predetermined range of signal frequencies.

17. The mechanical planarization apparatus according to claim 16, wherein said predetermined range of frequencies is from 30 Hertz to 100 Hertz.

18. The mechanical planarization apparatus according to claim 16, further comprising:

timer means for delaying said mechanical planarization signal from said filter means for a predetermined period prior to supplying said mechanical planarization signal to said mechanical planarization apparatus.

19. The mechanical planarization apparatus according to claim 15, further comprising noise filter means for conditioning said mechanical planarization signal from said filter means prior to supplying said mechanical planarization signal to said mechanical planarization apparatus.

20. The mechanical planarization apparatus according to claim 19, wherein said noise filter means includes signal integration means for integrating said mechanical planarization signal over time.

21. A method of planarizing a wafer comprising the steps of:

mechanically polishing a major surface of said wafer;

detecting a predetermined acoustic signal produced in a self-excitation made as a result of said mechanical polishing step; and controlling said mechanical polishing step in response to said acoustic signal.

22. The method according to claim 21, wherein said controlling step includes a step of terminating said polishing step.

23. The method according to claim 21, further comprising the step of bandpass filtering said acoustic signal after detection thereof by said detecting step.

24. The method according to claim 21, wherein said polishing step further comprises the steps of applying a polishing agent to the wafer and mechanically polishing the wafer with said polishing agent.

25. The method according to claim 21, further comprising the step of delaying said acoustic signal after detection thereof by said detecting step.

* * * * *